United States Patent [19]

Deforrest, Sr.

[11] Patent Number: 4,926,670

[45] Date of Patent: May 22, 1990

[54] EXTENSION FOR MORTISE CYLINDER

[75] Inventor: William Deforrest, Sr., Yorba Linda, Calif.

[73] Assignee: Major Lock Supply Inc., Anaheim, Calif.

[21] Appl. No.: 316,250

[22] Filed: Feb. 27, 1989

[51] Int. Cl.[5] ..... E05B 9/04

[52] U.S. Cl. ..... 70/374; 70/380; 70/461; 70/DIG. 60

[58] Field of Search ..... 70/374, 379 R, 380, 70/461, DIG. 60

[56] References Cited

U.S. PATENT DOCUMENTS

| | | | |
|---|---|---|---|
| 701,850 | 6/1902 | Cramond | 70/374 |
| 1,027,777 | 5/1912 | Shaw | 70/374 |
| 1,564,463 | 12/1925 | Best | 70/380 |
| 2,308,322 | 1/1943 | Voight | 70/374 |
| 2,381,136 | 8/1945 | Oshandler | 70/374 |

*Primary Examiner*—Robert L. Wolfe

*Attorney, Agent, or Firm*—Herb Boswell

[57] ABSTRACT

An extension for a mortise cylinder includes an extension body have a bore extending through it. First and second coupling elements are simultaneously located in the bore in the extension body and are free to rotate within the bore. A coupling slot on the first coupling element is for coupling with one of a rotating element on a mortise cylinder or a further mortise cylinder extension. A coupling tenon on the second coupling element is for coupling with a cam member or a further first coupling slot in a further first coupling element. An interconnecting tenon on the second coupling element fits into an interconnecting slot on the first coupling element for the propagation of rotation from the first coupling element to the second coupling element and to either a cam member or a further mortise cylinder extension coupled to the second coupling element.

22 Claims, 2 Drawing Sheets

EXTENSION FOR MORTISE CYLINDER

BACKGROUND OF THE INVENTION

This invention is directed to an extension for a mortise cylinder allowing use of the mortise cylinder in conjunction with a mortise lock on doors of varying thicknesses.

Mortise locks are widely used as a locks for doors. They are strong, capable of being manufactured to incorporate various features and because the components of the lock are encased within a lock housing they are adaptable to many different types of doors.

A typical mortise lock includes a lock housing, having an appropriate bolt or latch mechanism located therein to which are attached mortise cylinders. The mortise cylinders are manufactured either incorporating a cylinder lock, a thumb turn or as a blank. The various mortise cylinders thread into the body of the mortise lock itself to connect the cylinders to the lock.

Typically a mortise cylinder having a cylinder lock therein will be utilized on the outside of a door requiring a key to gain entrance to the door and either a cylinder lock, a thumb turn or a blank would be utilized on the interior of the door, depending upon the access capabilities desired for exiting from the interior through the door.

If it is desirous to also require the use of a key for exit, a mortise cylinder having a cylindrical lock would also be utilized on the interior of the door, if it was desired to be able to exit from the interior without a key either a thumb turn or a blank would be utilized in the mortise cylinder on the interior side of the door.

Heretofore there has been a certain limitation with respect to utilizing mortise locks on doors. This limitation resides in the length of the mortise cylinders available. Typically, mortise cylinders are available in two sizes: an inch and an eighth length and in an inch and a quarter length. After subtracting from this length an amount sufficient to thread the cylinder into the mortise lock body, the cylinders will only extend from the sides of the body anywhere from about ⅞ of an inch to about one inch. This, thus limits the thickness of the door which can be equipped with presently available mortise cylinders.

While it is conceivable that mortise cylinders could be made in a variety of other lengths to accommodate overly thick doors, since various mortise cylinders must be available incorporating cylinder locks, thumb turns and blanks and must further be available in various finishes some of which would only have very a limited market, manufacturers and suppliers have been hesitant to expand their commitment to supply and maintain an inventory of additional sizes of mortise cylinders. This has inhibited the use of the mortise cylinders in overly thick doors.

BRIEF DESCRIPTION OF THE INVENTION

It is a broad object of this invention to provide for extensions for mortise cylinders allowing these mortise cylinders to be utilized in doors of varying thicknesses. It is a further object of this invention to provide extension devices which, because of their engineering and construction principles inherent therein, do not detract from the security of the mortise lock on which the device is to be utilized. It is an additional object of this invention to provide for extensions for mortise cylinders which can be used singularly or in combination to provide for various extended cylinder lengths.

These and other objects as will become evident from the remainder of this specification are achieved in a mortise cylinder extension comprising an extension body having a bore extending there through. First and second coupling elements are sized and shaped to simultaneously be located in the extension body bore and to rotate within the bore. A first coupling means located on a first coupling element allows the first coupling element to be coupled to a rotating element on a mortise cylinder or to a further mortise cylinder extension. A second coupling means located on the second coupling element allows for attachment of a cam member or a further first coupling element to the second coupling element. A means for interconnecting the first and second coupling elements allows for transfer of rotation from the first coupling element to the second coupling element and to the cam member or a further first coupling element attached to the first coupling element.

In a preferred embodiment of the invention the various coupling means and interconnecting means comprise interlocking tenons and slots allowing for positive transfer of rotation from the mortise cylinder through the coupling elements to a cam member for activation of the latching mechanism of a mortise lock.

In an illustrative extension of the invention the first coupling means on the first coupling element comprises a coupling slot and the second coupling means on the second coupling element comprises a coupling tenon. Further the means for interconnecting the first and second coupling elements comprise an interconnecting tenon located on one of the first or second coupling elements and an interconnecting slot located on the other.

The mortise cylinder extensions of the invention further include means for fixedly attaching the extension body to a mortise lock and means for fixedly attaching the extension body to a mortise cylinder.

The bore in the extension body can advantageously be formed to include a circumferentially extending step dividing the bore into first and second coaxial cylindrical chambers of different diameters. The first coupling element can advantageously be formed as a cylindrical drum having opposing faces separated by a connecting cylindrical surface of a diameter sized to fit into and rotate within the first chamber of this bore. The second coupling element can advantageously be shaped as a stepped cylindrical drum having a circumferentially extending shoulder dividing the stepped drum into first and second coaxial cylindrical sections of different diameters. The diameter of the first section of this stepped drum is chosen to fit into and rotate within the first chamber of the bore and the diameter of the second section of the stepped drum is chosen to fit into and rotate within the second chamber of the bore. Further the diameter of the first section of the stepped drum is greater than the diameter of the second chamber of the bore and as a result thereof the second chamber of the bore serves to retain the second element within the bore.

The objects of the invention are further met in a mortise cylinder extension comprising a cylindrical extension body having opposing faces separated by a cylindrical surface and of a diameter equal to the diameter of a mortise cylinder. The cylindrical extension body includes first and second axial extending grooves formed in the cylindrical surface and extending the length of the cylindrical surface between the opposing faces. These axially extending grooves are circumferentially located 180° apart from one another at the ends of a respective diameter bisector of the cylindrical body. The outside of the cylindrical surface is threaded along the length of the cylindrical surface between the opposing faces for threading into a mortise lock.

The objects of the invention are further achieved in a method of adapting a mortise cylinder to accept an extension which comprises selecting a cylindrical mortise cylinder having a cam member attached to a rotating element via a control tenon. The cam member is removed from its attachment site on the control tenon of the rotating control element. A first coupling element is then attached to the control tenon on the rotating control element. The first coupling element is formed as a cylindrical drum having front and rear faces and a cylindrical surface extending between the faces with a coupling slot in the front face. The first coupling element is located on the mortise cylinder by positioning this coupling slot over the control tenon. Next a drilling guide is located over the mortise cylinder bearing the first coupling element attached thereto. The drilling guide is formed of a drilling body having a first cylindrical chamber and a second cylindrical chamber formed axially therein with the axis of rotation of the second cylindrical chamber located with respect to the axis of rotation of the first cylindrical chamber in a relationship which mimics the relationship of the axis of rotation of the rotating control element of the mortise cylinder with respect to the axis of rotation of the cylindrical mortise cylinder itself. The second cylindrical chamber intersects the first cylindrical chamber with the first cylindrical chamber sized and shaped to fit over the mortise cylinder and the second cylindrical chamber sized and shaped to fit over the first coupling element. The drilling guide further includes first and second elongated apertures extending axially with respect to the first and second cylindrical chambers. The first and second holes are drilled into the mortise cylinder utilizing the first and second elongated apertures as drilling guides and these holes are then tapped to form threads therein.

BRIEF DESCRIPTION OF THE DRAWINGS

This invention will be better understood when taken in conjunction with the drawings wherein.

This invention utilizes certain principles and/or concepts as are set forth in the claims appended hereto. Those skilled in the locksmithing arts will realize that these principles and/or concepts are capable of being utilized in a variety of embodiments which may differ from the exact embodiment utilized for illustrative purposes herein. For this reason this invention is not to be construed as being limited solely to the illustrative embodiment, but should only be construed in view of the claims.

DETAILED DESCRIPTION OF THE INVENTION

Figure 1:
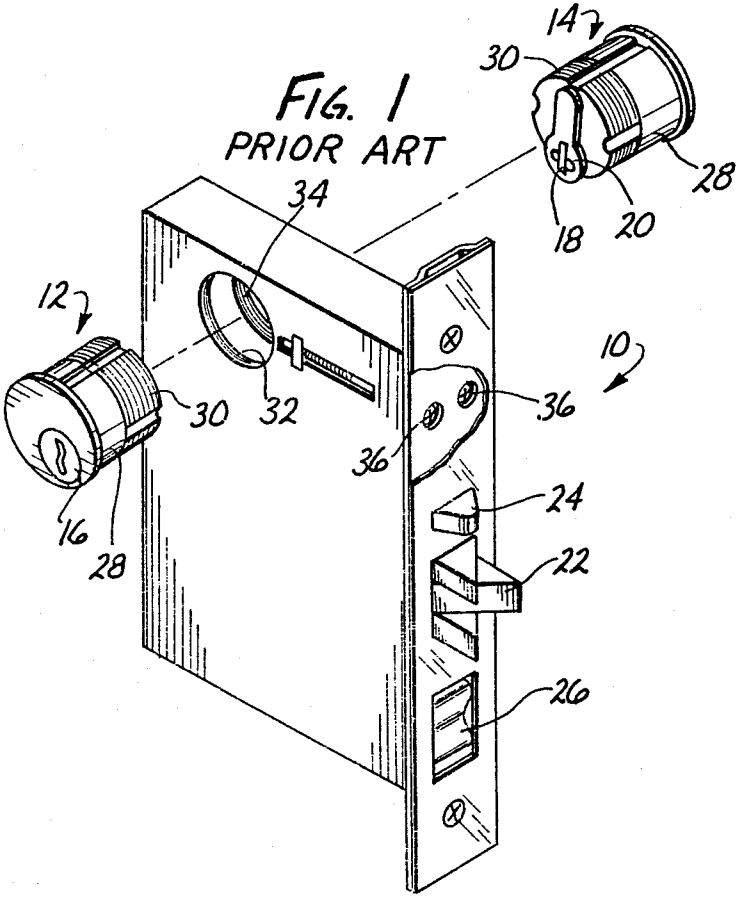
FIG. 1 PRIOR ART
FIG. 1 is an isometric view showing a typical prior art mortise lock including interior and exterior mortise cylinders attached thereto by threading into the body of the mortise lock.

FIG. 1 illustrates a typical prior art mortise lock and attaching mortise cylinders utilized in conjunction with the lock. Shown in the Figure is a mortise lock 10. It is a standard commercially available mortise lock as, for instance, a single point lock and latch mortise lock available from Lloyd Matheson, Inc., Charlestown, N.H.

Attaching to the lock 10 are identical front and rear mortise cylinders 12 and 14 respectively. Illustrative of the mortise cylinder 12 and 14 are cylinders available from Ilco Unican, Rocky Mount, NC.

Both of the cylinders 12 and 14, as illustrated in FIG. 1 include a common cylinder lock 16 which is seen from the front on the mortise cylinder 12 and as seen from the back on cylinder 14 includes a connecting tenon 18 on it which has a cam member 20 attached thereto. When the mortise cylinders 12 or 14 (or other mortise cylinders) are mounted to the mortise lock 10, their cam members 20 are positioned in the lock 10 in a position to interact with mechanisms within the lock 10 to activate the mechanism of the lock 10.

Since the lock 10 is a standard commercial lock a detailed description of it is not necessary with respect to the understanding of this invention. Briefly however, the lock 10 illustrated in FIG. 1 includes a latch 22 for interacting with a strike plate (not separately numbered or shown) attached to a door facing (not separately numbered or shown). Above the latch 22 is a point 24 which is located on the lock 10 to prevent unauthorized opening of the lock 10 by slipping a credit card or other thin member between a strike plate and the lock 10 in an attempt to operate the latch 22. Located below the latch 22 is a rocker switch 26 which fixes or frees the operation of a handle (not separately numbered or shown) attachable to the lock 10.

Each of the mortise cylinders 12 and 14 have a cylinder body, collectively identified by the numeral 28, which is threaded over a portion of its surface with threads, collectively identified by the numeral 30, which thread into appropriately threaded openings 32 and 34 in the lock body 10.

The mortise cylinders 12 and 14 are attached to the lock body 10 by threading them into the respective openings 32 and 34 and when they are threaded a sufficient distance into the lock body 10 such that their cam members 20 are free to rotate within the interior of the lock body 10 the mortise cylinders 12 and 14 are fixed in position by clamping them down with set screws, collectively identified by the numeral 36.

Figure 2:
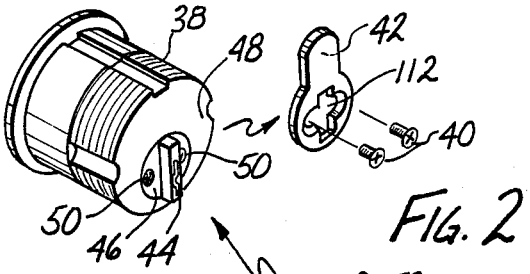
FIG. 2 is an isometric view showing the back face of a mortise cylinder, a cam member which is removed therefrom and a component of the invention which is attached thereto.

In FIG. 2 a mortise cylinder 38 identical to those of the cylinders 12 and 14 of FIG. 1 is illustrated. Two attaching screws, collectively identified by the numeral 40, which are utilized as, for instance in the mortise cylinder 14 of FIG. 1 to hold the cam member 20 on the mortise cylinder 14, have been removed. This allows withdrawal of the cam member 42 of FIG. 2 from the mortise cylinder 38.

When the cam member 42 has been removed from the mortise cylinder 38 a tenon 44 which is formed as a part of a cylinder lock 46 body is evident. In a like manner if a thumb turn was utilized with the mortise cylinder 38 instead of the cylinder lock body 46, a similar tenon as per the tenon 44 would be located on the end of the thumb turn which extends out of the back face 48 of the mortise cylinder 38. Also evident adjacent to the tenon 44 on the cylinder lock body 46 are two threaded holes, collectively identified by the number 50, in which the screws 40 thread to attach the cam member 42.

The cylinder lock body 46 (or a common thumb lever) thus serves as a rotating control element within the mortise cylinder 38. It includes a cam member attaching means, i.e. the tenon 44 and the threaded holes 50 formed thereon, utilized in attaching a cam member to this rotating control element.

Having removed the cam member 42 from the rear of the cylinder lock body 46, a drum shaped first control element 52 can be positioned on the cylinder lock body 46 in place of the cam member 42. The first control element 52 is formed as a drum having opposing faces 54 and 56 connected by a cylindrical surface 58. A coupling slot 60 is formed in drum face 54 and an interconnecting slot 62 is formed in drum face 56. Outboard of the slots 60 and 62 are two holes, collectively identified by the numeral 64, utilized in conjunction with the screws 40 to attach the first control element 52 to the cylinder lock body 46.

Having substituted the first control element 52 for the cam member 42, a drilling guide 66 is now utilized to drill two holes into the mortise cylinder 38. These holes will be utilized as a part of a means for connecting further components of the extensions of the invention to the mortise cylinder 38. The drilling guide 66 is shown in FIG. 3, both in solid lines in a position above the mortise cylinder 38 and, in phantom lines, in a position mounted on the mortise cylinder 38.

Figure 3:
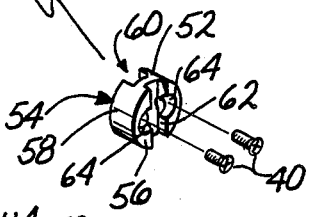
FIG. 3 is an isometric view showing a mortise cylinder having an element of the invention attached thereto and in conjunction with a drilling guide shown in both solid lines positioned above the mortise cylinder and in phantom lines positioned on the mortise cylinder.

The drilling guide 66 includes a first cylindrical chamber 68 shown in dotted line in the solid line representation of drilling guide 66 of FIG. 3. The first cylindrical chamber 68 is sized to be just slightly over sized with respect to the threaded portion of the body of the mortise cylinder 38 allowing the threaded portion of the body of the cylinder 38 to be located within this first cylindrical chamber 68.

The drilling guide 66 further includes a second cylindrical chamber 70 which is slightly oversized with respect to the first control element 52 allowing for positioning of the first control element 52 within the confines of the second cylindrical chamber 70.

The axis of rotation of the second cylindrical chamber 70 is related to the axis of rotation of the first cylindrical chamber 68 in a manner which mimics the relationship of the axis of rotation of the cylinder lock body 46 to the axis of rotation of the mortise cylinder 38. Because of this, when a mortise cylinder 38 having a first control element 52 attached thereto is located within the drilling guide 66, the body of the mortise cylinder 38 fits within the first cylindrical chamber and the body of the first control element 52 fits within the second cylindrical chamber.

Two drilling guide holes, collectively identified by the numeral 72 are further located in the drilling guide slightly above the second cylindrical chamber 70. The holes 72 open into the first cylindrical chamber 68. When the drilling guide 66 is located on the mortise cylinder 38 two appropriate holes are drilled through the drilling guide holes 72 into the body of the mortise cylinder 38. These holes can then be tapped forming threaded openings collectively identified by the numeral 74, shown in the mortise cylinder 38 of FIG. 4.

Figure 4:
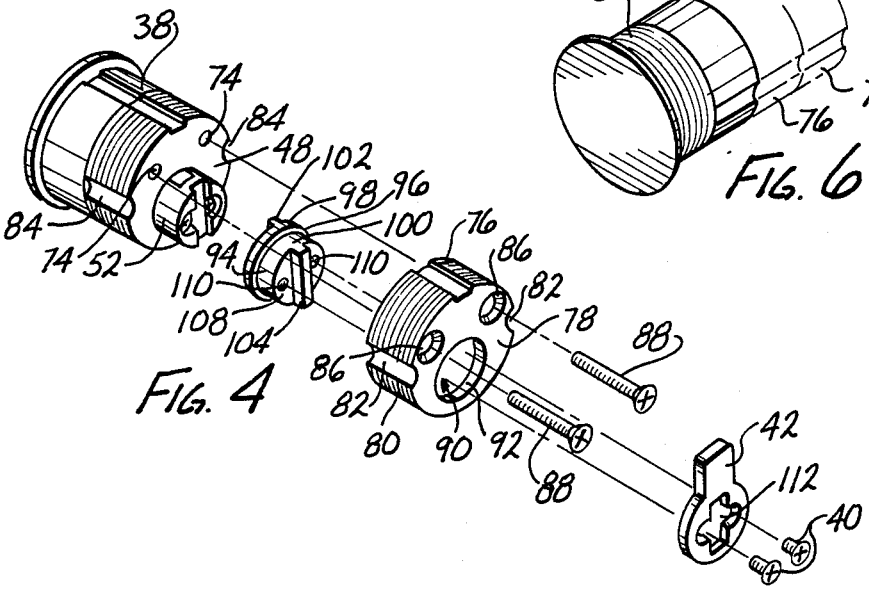
FIG. 4 is an isometric exploded view of a mortise cylinder and an extension of the invention which is attached thereto.

Further, shown in FIG. 4 is an extension body 76. The extension body 76 is formed as a cylinder of the same diameter as is the mortise cylinder 38. The cylindrical shape of the extension body 76 includes a face 78 and an opposing face (not separately identified or numbered) which are connected together by a cylindrical surface 80. The cylindrical surface 80 of the body 76 is threaded with threads matching the threads of the mortise cylinder 38. Further, first and second grooves, collectively identified by the numeral 82 are formed in the cylindrical surface 80 between the face 78 and the unseen face. The grooves 82 align with grooves, collectively identified by the numeral 84, formed on the mortise cylinder 38.

In the absence of an extension of this invention, the grooves 84 on the mortise cylinder 38 would be utilized to fixedly attach the mortise cylinder 38 to a lock, as for instance the lock 10, with set screws, as for instance the set screws 36 of FIG. 1. With the extension of the invention being attached to the mortise cylinder 38 the grooves 82 are utilized for locking the extension body 76 to the mortise lock, as for instance the mortise lock 10 of FIG. 1, and this in turn also locks the mortise cylinder 38 which ultimately is attached to the extension body 76.

The two grooves 82 can be considered to be located at the ends of a diameter bisector of the cylindrical body of the extension body 76. That is they are located 180° apart on the ends of an imaginary line (a diameter line) which passes through the center of rotation of the cylinder forming the body 76.

Two countersunk holes, collectively identified by the numeral 86, are formed in the face 78. These are positioned to align with the threaded opening 74 in the mortise cylinder 38. Two screws collectively identified by the numeral 88 are then utilized to secure the extension body 76 to the mortise cylinder 38.

The extension body 76 includes a bore therein which is divided into a first bore section 90 and a second bore section 92. The first bore section 90 is of a diameter slightly larger than the diameter of the first control element 52 allowing the first control element 52 to be located within the first bore section 90 and freely rotate therein.

A second control element 94 is shaped as a stepped cylindrical drum. It has a circumferentially extending shoulder 96 which divides this drum into two coaxial cylindrical sections, a larger diameter first section 98 and a smaller diameter second section 100. The first section 98 of the element 94 is of the same diameter as is the control element 52 and thus capable of fitting into and rotating within the first bore section 90 of the extension body 76.

An interconnecting tenon 102 is formed on the first section 98 of the element 94. The tenon 102 fits into the interconnecting slot 62 on the first control element 52. Together the interconnecting tenon 102 and interconnecting slot 62 form an interconnecting means between the first and second control elements 52 and 94.

The second section 100 of the element 94 is of a diameter slightly smaller than the diameter of the second bore section 92 of the extension body 76. This allows for positioning of the second control element 94 in the extension body 76 with the second section 100 of the control element 94 located within the second bore section 92 and the first section 98 of the control element 94 located within the first bore section 90 of the extension body 76.

The second control element 94 includes a coupling tenon 104 axially projecting from its second section 100. The second control element 94 is sized and shaped such that when the second control element 94 is positioned within the bore of the extension body 76 the shoulder 96 dividing the sections of this bore abuts against a shoulder 106 separating the first and second sections 98 and 100 of the control element 94. This positions a face 108 of the control element 94 flush with the face 78 of the extension body 76. As so positioned, the coupling tenon 104 on the element 94 now projects axially from the remainder of the control element 94 out of the bore in the extension body 76 beyond the face 78 of the extension body 76.

The control element 94 further includes two axially extending threaded holes, collectively identified by the numeral 110, which are located outboard of the coupling tenon 104. These are sized to accept a second set of the screws 40. The coupling tenon 104 is sized to fit within a coupling slot 112 formed in the cam member 42. The cam member 42 is located over the tenon 104 and fixedly attached to the second control element 94 via the screws 40.

With the cam member mounted on the coupling tenon, in essence the cam member 42 has been removed from the cylindrical lock body 46 and has been positioned distal from the cylindrical lock body 46 by a distance governed by the thickness of the extension body 76. Rotation of the cylindrical lock body 46, however, is transferred to the now distal cam member 46 via the tenon 44 and coupling slot 60 to the first control element 52 and via the interconnecting slot 62 and interconnecting tenon 102 to the second control element 94 and finally via the coupling tenon 104 to the cam member 42.

During production of a typical mortise cylinder, as for instance the prior art mortise cylinders 12 and 14 of FIG. 1 the cylinder lock 16 is inserted into the body of its mortise cylinder from the front face of the mortise cylinder. The cylinder lock 16 includes a flange (not numbered or shown in the figures) which abuts against the front face of its mortise cylinder. This fixes the cylinder lock 16 with respect to further axial movement into its mortise cylinder. Aside from its use to activate a mortise lock, the cam member 20 is utilized to lock the cylinder lock 16 against axial movement out of its mortise cylinder. Together the unnumbered flange and the cam member 20 retain the cylinder lock 16 within the body of its mortise cylinder, however, they allow for rotation of the cylinder lock 16 within the body of its mortise cylinder.

The diameter of the first control element 52 is selected to be slightly larger than the diameter of the cylinder lock body 46. As such like the cam member it replaces, when the first control element 52 is substituted for the cam member 42, it then serves to prevent withdrawal of the cylinder lock body 46 from its mortise cylinder 38.

In a like manner, because the first section 98 of the second control element 94 is larger than the second bore section 92 of the extension body 76, when the cam member 42 is attached to the second control element 94, the second control element 94 is axially fixed (but free to rotate) within the extension body 76. Conversely this also "rotationally" fixes the cam member 42 to the extension body 76, i.e. the cam member 42 rotates in unison with the second control element 94.

Screws 88 are used to fixedly attach the extension body 76 (having the cam member 42 attached thereto) to the mortise cylinder 38. This also serves to connect and position the cam member 42 with respect to the mortise cylinder 38. In effect this positions the cam member 42 at a fixed incremental distance away from the back face of the mortise cylinder 38 and extends the mortise cylinder 38 by this same fixed incremental distance.

It is evident that the axial dimensions of the extension body 76 and its first and second control elements 52 and 94 can be chosen at random to achieve any suitable sized extension for a mortise cylinder. Thus extensions of the invention having various axial dimensions might be utilized to achieve various extension lengths. For a longer extension, in reference to FIG. 4 the extension body 76 would be elongated and this would be utilized in conjunction with either an elongated first control element 52 or an elongated second control element 94 which was sized to extend throughout the additional length of the bore in the extended extension body 76.

Alternately, to achieve a greater length, a group of smaller dimensioned extensions could be ganged or daisy chained together to achieve a final extended length. Because the coupling tenon 104 on the second control element 94 is sized and shaped exactly the same as the tenon 44 on the cylinder lock body 46 and the coupling slot 62 in the first control element 52 is sized and shaped exactly the same as the slot 112 in the cam member 42 this allows daisy chaining or ganging of extensions of the invention to one another.

Figure 5:
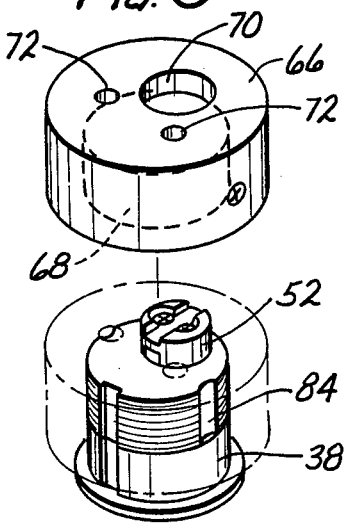
FIG. 5 is a side elevational view in partial section of two extensions of the invention attached to a mortise cylinder.
Figure 5:
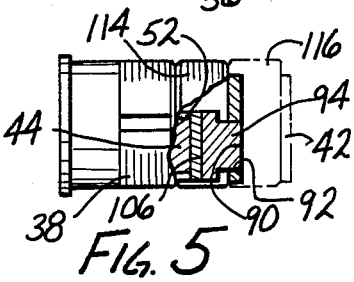

As seen in FIG. 5, a first extension member 114 of the invention is positioned between the mortise cylinder 38 and a second extension 116 of the invention. Both the extension members 114 and 116 are identical to the extension of FIG. 4. The cam member 42 is attached to the second control element 94 of the second extension 116. The coupling slot 60 of the first control element 52 of the second extension 116 fits over and mates with the coupling tenon 104 of the second control element 94 of the first extension 114. The coupling slot 60 of the first control element 52 of the first extension 114 fits over and mates with the mortise cylinder tenon 44. Two elongated screws (not separately numbered or shown in FIG. 5 but equivalent to screws 88) would then be utilized to conncurrently connect both the first and second extensions 114 and 116 to the mortise cylinder 38.

It is evident that the coupling tenon 104 of the second control element 94 of an extension of the invention is capable of being keyed either to a cam member, as for instance cam member 42 or a further first control element 52 of an additional extension. In a like manner, the coupling slot 60 of the first control element 52 is capable of being keyed or coupled to either to the tenon 44 of the cylinder lock body or other rotating element of a mortise cylinder or the coupling tenon 104 on the second control element of a further extension.

Figure 6:
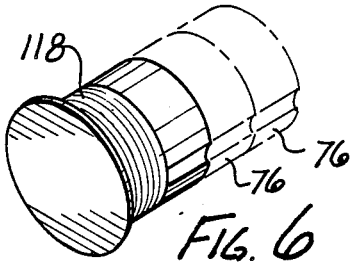
FIG. 6 is an isometric view of a mortise cylinder blank having two extension bodies attached thereto.

In FIG. 6, a mortise cylinder plug 118 is shown having two extension bodies, collectively identified by the numeral 76, attached thereto. This, thus lengthens the plug 118 by two increments of the size of the extension body 76. In extending a plug, as for instance, plug 118 it would not be necessary to utilize the first and second control elements 52 and 94 since a cam member is not to be attached to the plug 118.

Figure 7:
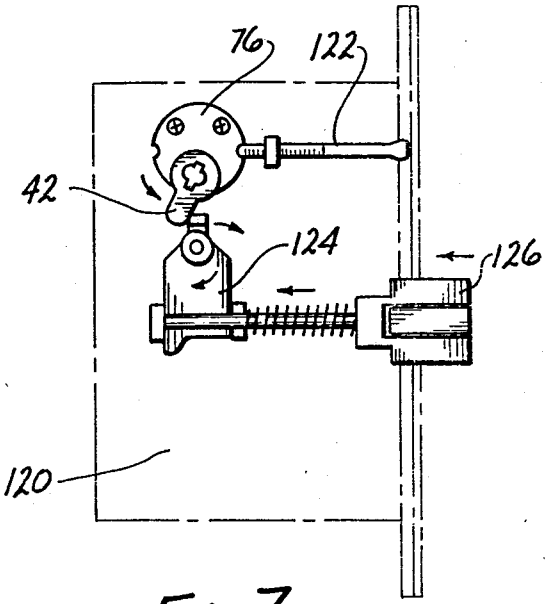
FIG. 7 is a representational side elevational view of a mortise cylinder having an extension of the invention attached thereto showing the location and operation of this cylinder in a mortise lock.

FIG. 7 shows the operation of a cam member 42 attached to an extension body 76. The extension body 76 attached to a mortise cylinder is threaded into the housing 120 of the mortise lock 10 and fixed thereto with a set screw 122 identical to the set screws 36 identified with the lock of FIG. 1. Rotation of the mortise cylinder elements and the elements of the extension attached thereto cause rotation of the cam member 42. The cam member 42 then interacts with the lever 124 to withdraw latch mechanism 126 of the lock.

A mortise cylinder equipped with an extension of the invention thus operates in exactly the same way as does a mortise cylinder without an extension of the invention, however the extensions of the invention allow for positioning of the mortise lock and its mortise cylinders in much wider doors or doors of non standard widths.

I claim:

1. In combination with a mortise cylinder of the type having a cylindrical body, a control element rotatively mounted in the body and a cam member attaching means on the control element for attaching a cam member to the control element, a cylinder extension comprising:

an extension body;

means for fixedly connecting said extension body to said mortise cylinder body;

said extension body including a bore extending through said extension body;

first and second coupling elements sized and shaped to simultaneously be located in said extension body bore and to rotate within said bore;

first coupling means for coupling said first coupling element to said cam member attaching means to couple said first coupling element to said mortise cylinder control element;

a cam member, said cam member including a mounting slot;

second coupling means located on said second coupling element for coupling said cam member to said second coupling element, said second coupling means comprising an attachment tenon located on said second coupling element, said attachment tenon sized and shaped to fit into said cam member mounting slot; and means for interconnecting said first and second coupling elements whereby when said cylinder extension is mounted on said mortise cylinder, rotation of said control element is transferred through said first coupling element to said second coupling element and to said cam member attached thereto.

2. The combination of claim 1 wherein:

said extension body has a cylindrical cross section matching the cross section of said mortise cylinder body.

3. The combination of claim 1 further including:

means for attaching said extension body to a mortise lock.

4. The combination of claim 1 wherein:

said bore is circular and includes a circumferentially extending step dividing said bore into first and second coaxial cylindrical chambers of different diameters.

5. A mortise cylinder extension comprising:

an extension body;

said extension body including a bore extending through said extension body;

first and second coupling elements sized and shaped to simultaneously be located in said extension body bore and to rotate within said bore;

first coupling means located on said first coupling element for coupling said first coupling element to one of a rotating element on a mortise cylinder or a further mortise cylinder extension;

second coupling means located on said second coupling element for attaching one of a cam member or a further first coupling element to said second coupling element; and means for interconnecting said first and second coupling elements whereby rotation of said first coupling element is transferred to said second coupling element and to said one of said cam member or said further first coupling element attached thereto, said means for interconnecting said first and second coupling elements comprising an interconnecting tenon located on one of said first or second coupling elements and an interconnecting slot located in the other of said first or second coupling elements, said interconnecting tenon and said interconnecting slot sized and shaped whereby said interconnecting tenon fits into said interconnecting slot.

6. A mortise cylinder extension of claim 5 including:

means for fixedly attaching said extension body to a mortise lock; and means for fixedly attaching said extension body to a mortise cylinder.

7. A mortise cylinder extension of claim 5 wherein:

said bore is circular and includes a circumferentially extending step dividing said bore into first and second coaxial cylindrical chambers of different diameters.

8. A method of adapting a mortise cylinder to accept an extension comprising:

selecting a cylindrical mortise cylinder having a cam member attached to a rotating control element via a control element tenon;

removing said cam member from its attachment site on said control element tenon of said rotating control element;

attaching a first coupling element to said control element tenon on said rotating control element, said first coupling element formed as a cylindrical drum having front and rear faces and a cylindrical surface extending between said faces with a coupling slot in said front face, said first coupling element located on said mortise cylinder by positioning said coupling slot over said control element tenon;

locating a drilling guide on said mortise cylinder bearing said first coupling element attached thereto, said drilling guide formed of a drilling body having a first cylindrical chamber and a second cylindrical chamber formed axially therein with the axis of rotation of said second cylindrical chamber located with respect to the axis of rotation of said first cylindrical chamber in a relationship which mimics the relationship of the axis of rotation of said rotating control element with respect to the axis of rotation of said cylindrical mortise cylinder and with said second cylindrical chamber intersecting said first cylindrical chamber and wherein said first cylindrical chamber is sized and shaped to fit over said mortise cylinder and said second cylindrical chamber is sized and shaped to fit over said first coupling element attached to said mortise cylinder and further said drilling body includes first and second elongated apertures extending axially with respect to said first and second cylindrical chambers;

drilling first and second holes in said mortise cylinder utilizing said first and second elongated apertures as drilling guides;

tapping said first and second holes in said mortise cylinder to form threads therein.

9. In combination with a mortise cylinder of the type having a cylindrical body, a control element rotatively mounted in the body and a cam member attaching means on the control element for attaching a cam member to the control element, a cylinder extension comprising:

an extension body;

means for fixedly connecting said extension body to said mortise cylinder body;

said extension body including a circular bore extending through said extension body, said circular bore including a circumferentially extending step dividing said bore into first and second coaxial cylindrical chambers of different diameters;

first and second coupling elements sized and shaped to simultaneously be located in said extension body bore and to rotate within said bore;

first coupling means for coupling said first coupling element to said cam member attaching means to coupled said first coupling element to said mortise cylinder control element;

a cam member;

second coupling means located on said second coupling element for coupling said cam member to said second coupling element; and means for interconnecting said first and second coupling elements whereby when said cylinder extension is mounted on said mortise cylinder, rotation of said control element is transferred through said first coupling element to said second coupling element and to said cam member attached thereto.

10. The combination of claim 9 wherein:

said cam member includes a mounting slot; and said second coupling means comprises an attachment tenon located on said second coupling element, said attachment tenon sized and shaped to fit into said cam member mounting slot.

11. The combination of claim 9 wherein:

said second coupling element is shaped as a stepped cylindrical drum having a circumferentially extending shoulder dividing said stepped drum into first and second coaxial cylindrical sections of different diameters, said first section of said stepped drum having a diameter sized to fit into and rotate in said first chamber of said bore and said second section of said stepped drum having a diameter sized to fit into and rotate in said second chamber of said bore; and wherein said diameter of said first section of said stepped drum is greater than the diameter of said second chamber of said bore.

12. The combination of claim 9 wherein:

said first coupling element is shaped as a cylindrical drum having opposing faces connected by a cylindrical surface and of a diameter sized to fit into and rotate in said first chamber of said bore.

13. The combination of claim 12 wherein:

said first coupling means includes a coupling slot formed in one of said faces of said first coupling element cylindrical drum.

14. The combination of claim 11 wherein:

said cam member includes a mounting slot;

said second coupling means comprises an attachment tenon located on said second coupling element, said attachment tenon sized and shaped to fit into said cam member mounting slot; and said attachment tenon axially extending from said second section of said second coupling element.

15. The combination of claim 14 wherein:

said means for interconnecting said first and second coupling elements comprises an interconnecting tenon located on said first section of said second coupling element and an interconnecting slot located on said first coupling element;

said interconnecting tenon extending axially from said first section of said second coupling element; and said interconnecting tenon and said interconnecting slot sized and shaped whereby said interconnecting tenon fits into said interconnecting slot.

16. The combination of claim 15 wherein:

said first coupling means includes a coupling slot located on said first coupling element distal from said interconnecting slot.

17. A mortise cylinder extension comprising:

an extension body;

said extension body including a circular bore extending through said extension body, said bore including a circumferentially extending step dividing said bore into first and second coaxial cylindrical chambers of different diameters.

first and second coupling elements sized and shaped to simultaneously be located in said extension body bore and to rotate within said bore;

first coupling means located on said first coupling element for coupling said first coupling element to one of a rotating element on a mortise cylinder or a further mortise cylinder extension;

second coupling means located on said second coupling element for attaching one of a cam member or a further first coupling element to said second coupling element; and means for interconnecting said first a nd second coupling elements whereby rotation of said first coupling element is transferred to said second coupling element and to said one of said cam member or said further first coupling element attached thereto.

18. A mortise cylinder extension of claim 17 wherein:

said means for interconnecting said first and second coupling elements comprises an interconnecting tenon located on one of said first or second coupling elements and an interconnecting slot located in the other of said first or second coupling elements, said interconnecting tenon and said interconnecting slot sized and shaped whereby said interconnecting tenon fits into said interconnecting slot.

19. A mortise cylinder extension of claim 17 wherein:

said second coupling element is shaped as a stepped cylindrical drum having a circumferentially extending shoulder dividing said stepped drum into first and second coaxial cylindrical sections of different diameters, said first section of said stepped drum having a diameter sized to fit into and rotate in said first chamber of said bore and said second section of said stepped drum having a diameter sized to fit into and rotate in said second chamber of said bore; and wherein said diameter of said first section of said stepped drum is greater than the diameter of said second chamber of said bore.

20. A mortise cylinder extension of claim 19 wherein:

said means for interconnecting said first and second coupling elements comprises an interconnecting tenon located on said first section of said second coupling element and an interconnecting slot located on said first coupling element;

said interconnecting tenon extending axially from said first section of said second coupling element; and said interconnecting tenon and said interconnecting slot sized and shaped whereby said interconnecting tenon fits into said interconnecting slot.

21. A mortise cylinder extension of claim 20 wherein:

said first coupling element is shaped as a cylindrical drum having opposing faces separated by a connecting cylindrical surface and of a diameter sized to fit into and rotate in said first chamber of said bore; and said first coupling means includes a coupling slot formed in one of said opposing faces; and said interconnecting slot formed in the other of said opposing faces.

22. A mortise cylinder extension of claim 21 wherein:

said second coupling means includes a coupling tenon located on and extending axially from said second section of said second coupling element.

* * * * *